US005466265A

United States Patent [19]

Riegels et al.

[11] Patent Number: 5,466,265

[45] Date of Patent: Nov. 14, 1995

[54] LITHIUM-CONTAINING ASSISTANTS FOR DYEING AND PRINTING OF CELLULOSIC AND/OR REGENERATED CELLULOSIC MATERIALS

[75] Inventors: Martin Riegels, Leichlingen; Joachim Grütze, Odenthal, both of Germany

[73] Assignee: Bayer Aktiengesellschaft, Leverkusen, Germany

[21] Appl. No.: 242,760

[22] Filed: May 13, 1994

[30] Foreign Application Priority Data

May 21, 1993 [DE] Germany ..... 43 17 075.7

[51] Int. Cl.[6] ..... D06P 3/60; D06P 1/44

[52] U.S. Cl. ..... 8/594; 8/618; 8/543; 8/918; 8/921; 8/937; 8/673; 8/680

[58] Field of Search ..... 8/532, 543–549, 8/594, 618, 908–912, 918, 921, 937

[56] References Cited

U.S. PATENT DOCUMENTS 4,832,698 5/1989 Ikeou et al. ..... 8/527

5,256,161 4/1992 Grutze et al. ..... 8/527

FOREIGN PATENT DOCUMENTS 0511571 5/1992 European Pat. Off. .
1265456 7/1970 United Kingdom .
1367708 12/1972 United Kingdom .
2014195 12/1978 United Kingdom .

OTHER PUBLICATIONS

Textiles, Paper, Cellulose—pp. 11–12, Week T44 Old Law 26.10—Nov. 1, 1972.

JA 7243155, "Dyeing fibres or mouldings", Derwent Abstract, pp. 11–12 (Nov. 1, 1972).

*Primary Examiner*—Margaret Einsmann
*Attorney, Agent, or Firm*—Sprung Horn Kramer & Woods

[57] ABSTRACT

Improved dyeings or prints on cellulose, regenerated cellulose and/or mixtures of cellulose with natural or synthetic fiber materials using one or more reactive and/or direct dyes are obtained in the presence of a lithium compound.

6 Claims, No Drawings

LITHIUM-CONTAINING ASSISTANTS FOR DYEING AND PRINTING OF CELLULOSIC AND/OR REGENERATED CELLULOSIC MATERIALS

BACKGROUND OF THE INVENTION

1. Field of the Invention

The invention relates to lithium-containing assistants and to their use for textile dyeing and printing.

When, in textile dyeing, sulpho-containing reactive or direct dyes are used for native and regenerated cotton, anionic textile auxiliaries are used for improving the passage of the cloth and for levelling the fabric appearance.

A large number of dyes have only limited solubility and can precipitate unevenly on cotton, causing unlevel dyeings. The use of conventional dyeing assistants does not allow a satisfactory improvement to be achieved in all cases.

Moreover, wetting agents are used for improving the wettability and liquor penetration of the material to be dyed. These anionic surfactants were hitherto added to the dyebath in the form of their sodium or potassium salts, for example dialkyl phosphates or diaryl phosphates, fatty alcohol sulphonates or fatty alcohol sulphates, and anionic dispersants, in particular the sodium or potassium salts of sulphonated, aromatic condensation products, for example of naphthalene, formaldehyde and sulphuric acid.

When fibre mixtures, for example fibre mixtures composed of cotton and polyester or cotton and polyamide, are dyed, it is customary to add non-ionic surfactants to the dyebath, for example alkoxylated fatty alcohols, alkoxylated alkylphenols and alkoxylated synthetic hydrophobic parent structures.

To increase the solubility of the dye in water, it is customary to add assistants to the dyebath or to the padding dyestuff liquor, for example ε-caprolactam, polyvinylpyrrolidones and alkylamidedicarboxylic acids.

The disadvantage here is, inter alia, that the dyeing is still unlevel due to the fact that the dye is not distributed uniformly on the fibre.

2. Description of the Related Art

It has also been disclosed to carry out dyeings in the presence of $Li^+$. EP-A-511,571 describes the addition of water-soluble Li compounds, in particular $LiHCO_3$ to the aqueous preparation of the dye. JP-A-72.43155 describes the dyeing of fibres and plastics using cationic dyes in the presence of surface-active compounds, which can be Li salts.

SUMMARY OF THE INVENTION

The invention is based on the object of providing an improved dyeing process and improved dyeing assistants.

The invention relates to a process for dyeing or printing cellulose, regenerated cellulose and/or mixtures of cellulose with natural or synthetic fiber materials with a reactive and/or direct dye in the presence of a dyeing assistant, characterized in that the dyeing assistant is essentially employed in the form of a lithium salt.

DETAILED DESCRIPTION OF THE INVENTION

In a preferred embodiment, the dyeing assistant is added to the dye liquor before the dye and can act on the cellulose before the dye is added. In a particularly preferred embodiment, 0.02 to 5.0 g of lithium cations, preferably 0.1 to 2 g, are employed per 100 g of cellulose to be dyed. The assistant to be used according to the invention can preferably be wetting agents, dispersants and organic lithium salts.

The use of the lithium compounds results in dyeings which, surprisingly, are markedly more level and, in some cases, have a greater depth of shade and are more brilliant than those comparative dyeings which are carried out with the corresponding sodium salts or without dyeing assistants.

The anionic dyeing assistants to be used according to the invention are synthesized in a manner known from the literature. However, the acidic compounds are neutralized in all cases with a lithium compound, preferably lithium hydroxide. If the sodium, potassium or ammonium salts of the anionic products are present, the free acid is obtained via an acidic ion exchanger and subsequently neutralized using lithium hydroxide.

I) In a preferred embodiment of the process according to the invention, an anionic wetting agent is added to the dyebath. Examples of compound classes which can be employed are the following.

1. Dialkyl phosphates or diaryl phosphates of the general formula:

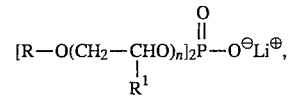

in which

R represents $C_4$–$C_{20}$-alkyl or aryl, $R^1$ represents hydrogen, methyl, ethyl or phenyl and n represents a number from 0 to 6.

2. Fatty alcohol sulphonates or fatty alcohol sulphates of the following formula:

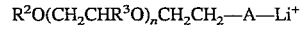

in which $R^2$ represents $C_{12}$–$C_{22}$ -alkyl, $C_{12}$–$C_{22}$ -alkenyl or $C_{12}$–$C_{22}$ -cyloalkyl, $R^3$ represents hydrogen, methyl, ethyl or phenyl, n represents a number from 12 to 60 and A represents an anionic group, in particular $—OSO_3^{\ominus}$ or $—SO_3^{\ominus}$.

3. Sulphonated castor oils (Turkey-red oils) in the form of lithium salts.

4. Li alkylarylsulphonates, such as, for example, dodecylbenzenesulphonic acid in the form of its lithium salts.

5. Sulphonated acid amides of higher-molecular-weight, unsaturated fatty acids of the general formula

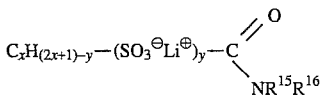

in which:

$R^{15}$ and $R^{16}$ are $C_1$–$C_6$-alkyl, x is 12–18 (integers), y is 1–3, for example the sulphation product of n-diisobutyleamide of oleic acid

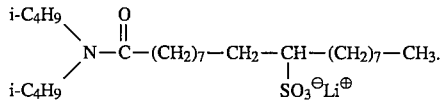

6. Alkylated naphthalenesulphonic acids in the form of lithium salts, for example:

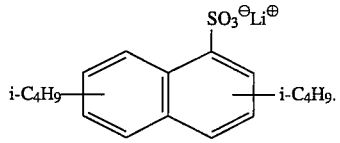

7. Sulphosuccinates of the general formula:

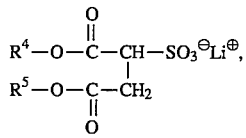

in which $R^4$ and $R^5$ independently of one another represent $C_6$–$C_{22}$-alkyl or $C_6$–$C_{22}$-alkenyl.

8. α-Sulpho-fatty acid esters

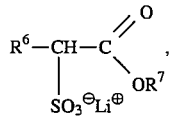

in which $R^6$ and $R^7$ independently of one another represent $C_6$–$C_{18}$-alkyl.

II) In a further preferred use form, anionic dispersants, again in the form of their lithium salts, are added to dyebath. Examples of such compounds which may be mentioned are:

1. Sulphonated, aromatic condensation products, for example of naphthalene, formaldehyde and sulphuric acid as lithium salts, in particular of the formula

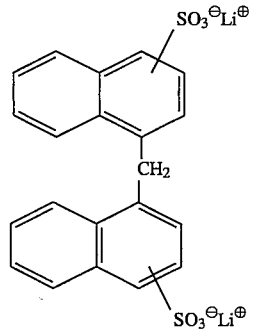

2. Compounds of the formula

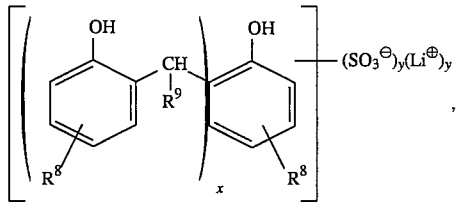

in which $R^8$ independently of its individual occurrence represents $C_4$–$C_{12}$-alkyl, $C_1$–$C_{12}$-alkoxy, phenyl, cyclohexyl or $C_2$–$C_8$-hydroxyalkoxy, $R^9$ independently of one another represents hydrogen or $C_1$–$C_4$-alkyl, x represents a number from 1 to 10 and Y independently of one another represents numbers from 1 to x+1.

3. Polycondensates of a) Various alkylsulphonic acids with halogenoarylsulphonic acids, the main component having the following formula:

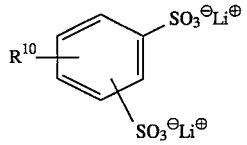

in which $R^{10}$ represents $C_6$–$C_{22}$-alkyl or $C_6$–$C_{22}$-alkenyl.

b) Reactive alkylaryl compounds with aromatic sulphonic acids, such as, for example, benzyl chloride with naphthalenesulphonic acid, the main component having the following formula:

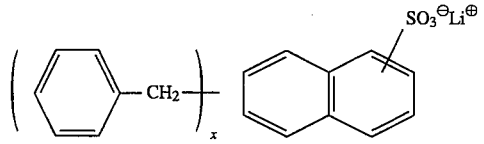

in which x represents 1–3.

c) Diphenyl ether derivatives, inter alia with arylsulphonates and formaldehyde, the main component having the following formula:

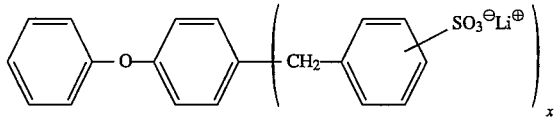

in which x represents 1–3.

d) Cresolsulphonic acids with formaldehyde, the main component being the following formula:

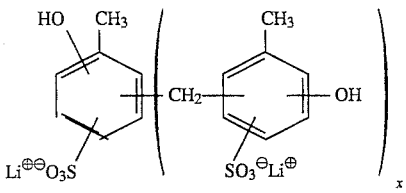

in which x represents 1–3.

e) Urea-formaldehyde with phenolsulphonic acid, the main component having the following formula:

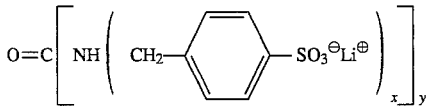

in which x is 1 and y can be 1 or 2.

III) Moreover, other customary, non-ionic surfactants can be added to the dyebath, such as, for example, 1. alkoxylated fatty alcohols,
2. alkoxylated alkylphenols and
3. alkoxylated synthetic hydrophobic parent structures.

IV) In a further preferred embodiment, dyeing assistants are added to the dyebath which can improve the solubility of the dyes, such as, for example, 1. ε-caprolactam,
2. polyvinylpyrrolidones,
3. compounds of the formula

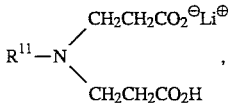

in which $R^{11}$ represents $C_6$–$C_{22}$-alkyl.

V) The preparations according to the invention can be prepared by simply stirring the abovementioned components from I to III and, if appropriate, IV at temperatures from 20° to 80° C.

With an addition of water and/or a solvent which is miscible with water, they are obtained as homogenous, preferably clear, mixtures.

The preparations advantageously contain, in each case based on the entire preparation, 5–50% by weight of one or more components from I 5–30% by weight of one or more components from II, 0–40% by weight of one or more components from III 0–30% by weight of one or more components from IV 0–80% by weight of water and/or an organic solvent which is miscible with water, for example glycols, isopropanol and/or 1-alkoxy- 2-alkanols, in particular 1-methoxy-2-propanol.

The components from I–IV which are intended for the mixture can, if required, also be used individually. Moreover, the abovementioned components I–IV do not necessarily have to be completely in the form of the Li salt, but can partly also be in the form of the $Na^+$, $K^+$ or ammonium salt.

Even though, in a further embodiment of the invention, any dyeing assistant can be used, an inorganic Li salt is added to the dye liquor prior to the dye and, if appropriate, prior to an assistant, so that it can act on the substrate .to be dyed before the dyeing process. Particularly suitable for this purpose are LiCl, LiBr, LiI, $Li_2SO_4$ and LiOH.

The inorganic Li salt is preferably employed in an amount of 0.1 to 2 g of lithium cations per 100 g of cotton to be dyed.

In a further embodiment of the invention, all or part of the alkaline fixing agent required for fixing reactive dyes on cellulose and the abovementioned dye mixtures can be replaced by LiOH.

EXAMPLE 1

2 g of the formulation according to the invention, composed of

10% by weight of lithium di-2-ethylhexyl phosphate,

15% by weight of ε-caprolactam,

9% by weight of ethylene glycol and

66% by weight of water are added, at 25° C., to 1000 ml of an aqueous dye liquor containing 100 g of a knitted cotton fabric. The following formulations can also be used with equally good success:

a) 10% by weight of lithium di-2-ethylhexyl phosphate, 3% by weight of lithium naphthalenesulphonate/-formaldehyde condensation product 5% by weight of polyvinylpyrrolidone 10% by weight of ethylene glycol 72% by weight of water b) 15% by weight of lithium dodecyl sulphate, 5% by weight of addition product of oleyl alcohol and ethylene oxide, 6% by weight of addition product of decyl alcohol, ethylene oxide and propylene oxide, 10% by weight of ethylene glycol 72% by weight of water c) 15% by weight of sulphonated castor oil neutralized with lithium hydroxide, 4% by weight of addition product of oleyl alcohol and ethylene oxide, 5% by weight of 1-methoxy-2-propanol, 5% by weight of ethylene glycol 71% by weight of water d) 5% by weight of sodium naphthalenesulphonate/formaldehyde condensation product, 10% by weight of ε-caprolactam, 10% by weight of lithium sulphate, 75% by weight of water.

Equally, the formulation according to the invention can also be employed under the process conditions customary in reactive dyeing.

Then, 1 g of a sulpho-containing reactive dye of the formula

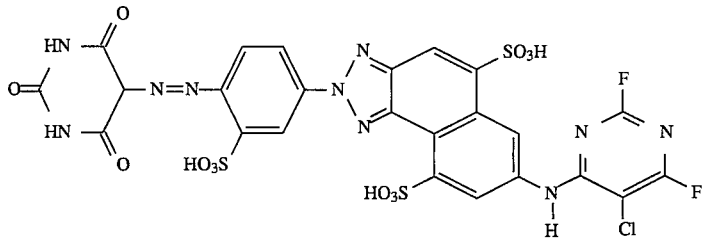

is added, followed by 50 g of sodium chloride, with stirring. After a dyeing time of 30 minutes, 5 g of sodium carbonate are added to the dye liquor as fixing agent, and the dye is fixed for 30 minutes at 50° C.

EXAMPLE 2

2 g of the formulation according to the invention of Example 1 are added, at 40° C. to 1000 ml of an aqueous dye liquor containing 100 g of a knitted cotton fabric. Then, 1 g of a sulpho-containing direct dye of the formula

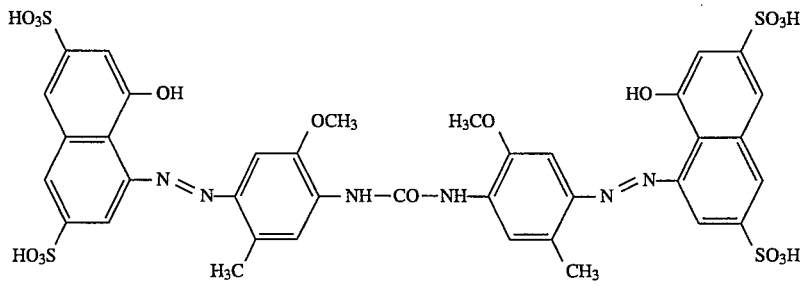

is added, followed by 20 g of sodium chloride, with stirring.

Within 30 minutes, the dyeing temperature is set at 90° C. and dyeing is continued for 15 minutes at this temperature.

EXAMPLE 3

2 g of the formulation according to the invention of Example 1 are added, at 70° C. to 1000 ml of an aqueous dye liquor containing 100 g of cotton yarn.

Then, 125 g of a mixture of sulpho-containing reactive dyes of the formulae

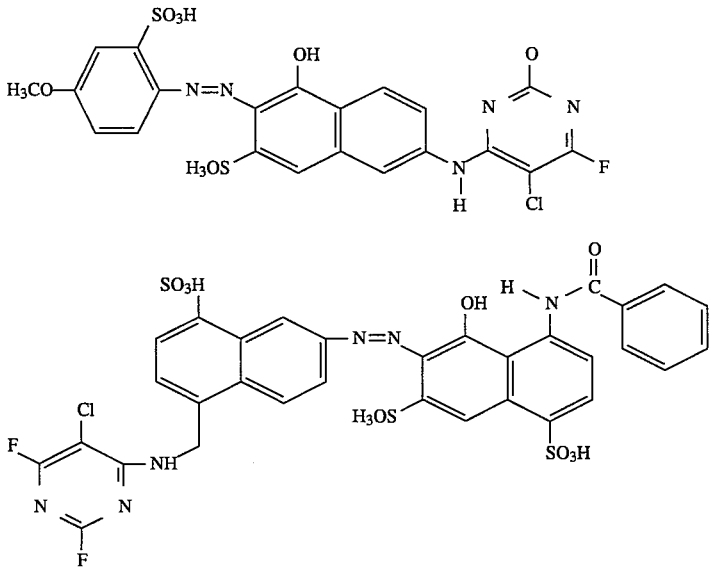

are added to the dye liquor, and the dyeing is fixed.

EXAMPLE 4

2 g of the formulation according to the invention of Example 1 are added, with stirring, to a padding liquor composed of 20 g/l $Na_2CO_3$ and 1 ml/l NaOH (40% strength).

After 10 g of reactive dye of the formula

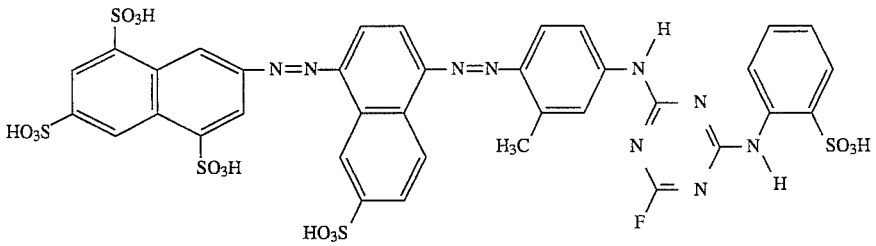

have been added to this liquor batch, cotton wovens are dyed level, the fixing time being 15 hours.

All examples give excellent dyeings with high levelness.

What is claimed is:

1. In the dyeing or printing of a cellulose-containing material, wherein a cellulose-containing material is first wet with a liquid containing a dyeing assistant, and the wet material is thereafter contacted with a dye, the improvement wherein the material is contacted with a lithium cation-containing compound prior to contact with the dye.

2. The process according to claim 1, wherein the lithium cation-containing compound is a lithium salt of a dyeing assistant.

3. The process according to claim 1, wherein the lithium cation-containing compound is the lithium salt of an anionic wetting agent or an anionic dispersant.

4. The process according to claim 1, wherein the lithium cation-containing compound is lithium acetate.

5. The process according to claim 5, wherein the lithium cation-containing compound is lithium sulphate.

6. The process according to claim 1, wherein the lithium cation-containing compound is present in 0.2 to 0.3 g per 100 g of cellulose to be dyed.

* * * * *

UNITED STATES PATENT AND TRADEMARK OFFICE

CERTIFICATE OF CORRECTION

PATENT NO. : 5,466,265

DATED : November 14, 1995

INVENTOR(S) : Riegels, et al.

It is certified that error appears in the above-identified patent and that said Letters Patent is hereby corrected as shown below:

Col. 10, claim 5, Delete claim " 5 " and substitute -- 1 --
line 1

Signed and Sealed this

Ninth Day of April, 1996

*Attest:*

*Attesting Officer*

BRUCE LEHMAN

*Commissioner of Patents and Trademarks*